US009989220B2

(12) United States Patent
Van Delden et al.

(10) Patent No.: US 9,989,220 B2
(45) Date of Patent: Jun. 5, 2018

(54) LIGHTING MODULE AND HOUSING

(71) Applicant: PHILIPS LIGHTING HOLDING B.V., Eindhoven (NL)

(72) Inventors: Martinus Hermanus Wilhelmus Maria Van Delden, Eindhoven (NL); Reinier Imre Anton Den Boer, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days. days.

(21) Appl. No.: 15/506,178

(22) PCT Filed: Jul. 30, 2015

(86) PCT No.: PCT/EP2015/067586

§ 371 (c)(1),
(2) Date: Feb. 23, 2017

(87) PCT Pub. No.: WO2016/030128

PCT Pub. Date: Mar. 3, 2016

(65) Prior Publication Data

US 2017/0254513 A1 Sep. 7, 2017

(30) Foreign Application Priority Data

Aug. 29, 2014 (EP) ..... 14182895

(51) Int. Cl.
*F21S 4/22* (2016.01)
*F21V 15/01* (2006.01)
(Continued)

(52) U.S. Cl.
CPC ..... *F21V 15/01* (2013.01); *F21S 4/20* (2016.01); *F21V 3/02* (2013.01); *F21V 23/003* (2013.01); *F21V 23/005* (2013.01); *F21V 23/06* (2013.01); *F21V 29/70* (2015.01); *F21V 31/00* (2013.01); *F21Y 2115/10* (2016.08)

(58) Field of Classification Search
CPC . F21V 15/01; F21V 29/70; F21V 3/02; F21V 23/003; F21V 23/005; F21V 23/06; F21V 31/00; F21S 4/20; F21S 4/22; F21Y 2115/10
See application file for complete search history.

(56) References Cited

U.S. PATENT DOCUMENTS 9,869,456 B2 * 1/2018 Speer ..... F21V 15/012
2008/0074901 A1 * 3/2008 David ..... F21S 8/00 362/612

(Continued)

FOREIGN PATENT DOCUMENTS

EP 0870980 A1 10/1998
EP 1041211 A2 10/2000

(Continued)

*Primary Examiner* — Mary Ellen Bowman

(57) ABSTRACT

A lighting device is provided. The light device (1) comprises a light source (2), a driver (3) for providing an output to said light source (2), and a first housing (4). The first housing (4) comprises a blister pack with at least one compartment suitable for locating said light source (2) and driver (3). A second housing (6) may also be provided and the second housing (6) may advantageously comprise a luminaire.

11 Claims, 4 Drawing Sheets

(51) Int. Cl.

| | |
|---|---|
| ***F21V 31/00*** | (2006.01) |
| ***F21V 23/00*** | (2015.01) |
| ***F21V 29/70*** | (2015.01) |
| ***F21S 4/20*** | (2016.01) |
| ***F21V 3/02*** | (2006.01) |
| ***F21V 23/06*** | (2006.01) |
| *F21Y 115/10* | (2016.01) |

(56) References Cited

U.S. PATENT DOCUMENTS

2009/0296382 A1* 12/2009 Maier ..... F21V 15/01 362/218
2010/0073957 A1* 3/2010 Mills ..... A61C 19/004 362/555
2011/0163683 A1* 7/2011 Steele ..... F21V 7/00 315/192
2012/0051040 A1* 3/2012 Hsia ..... F21V 25/04 362/221
2012/0182755 A1* 7/2012 Wildner ..... G09F 9/301 362/555
2013/0094200 A1 4/2013 Dellian et al.
2016/0000657 A1* 1/2016 Dickie ..... A61J 7/0481 206/534

FOREIGN PATENT DOCUMENTS

| | | | |
|---|---|---|---|
| GB | 2400433 | A | 10/2004 |
| JP | 2005310526 | A | 11/2005 |
| NL | 2003183 | C | 1/2011 |
| WO | 2014041172 | A1 | 3/2014 |

* cited by examiner

LIGHTING MODULE AND HOUSING

CROSS-REFERENCE TO PRIOR APPLICATIONS

This application is the U.S. National Phase application under 35 U.S.C. § 371 of International Application No. PCT/EP2015/067586, filed on Jul. 30, 2015 which claims the benefit of European Patent Application No. 14182895.4, filed on Aug. 29, 2014. These applications are hereby incorporated by reference herein.

FIELD OF THE INVENTION

This invention relates to the field of lighting devices, and more specifically to a luminaire.

BACKGROUND TO THE INVENTION

Battens are so-called linear light sources. They may comprise of a linear housing with either one, two or three non-replaceable linear light sources on top and/or a side of the housing. Some battens can be connected together using integrated connectors.

EP0870980 entitled "Luminaire for line illumination" describes a luminaire comprising an elongate batten.

SUMMARY OF THE INVENTION

Connected batten luminaires allow the creation of light lines up to approximately 8, 4-foot units using only a single power line socket. Typically the housing of a batten is made from extruded aluminum or plastic. The production processes for extruding aluminum or plastic are a mature technology and have been extensively optimized.

A batten without a housing is known as a light-tube, such as a fluorescent light tube or tubular LED (TLED). To operate, a light tube requires an external means of fixation and a means to deliver power to the light tube. These functions are provided by the power sockets of light tube holders. Furthermore, light tubes cannot be connected together because the through wire option is missing, this function is fulfilled by the housing of the batten.

Thus, there is a need for a housing of reduced size and/or complexity. It would be further advantageous to achieve a housing that is easy to manufacture and that is easy to recycle at the end of its life.

To better address one or more of these concerns, in a first aspect of the invention, there is provided a lighting device comprising:

a light source, a driver for providing an output to said light source, and a first housing, wherein said first housing comprises a blister pack with at least one compartment suitable for locating said light source and driver.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF EMBODIMENTS

Figure 1:
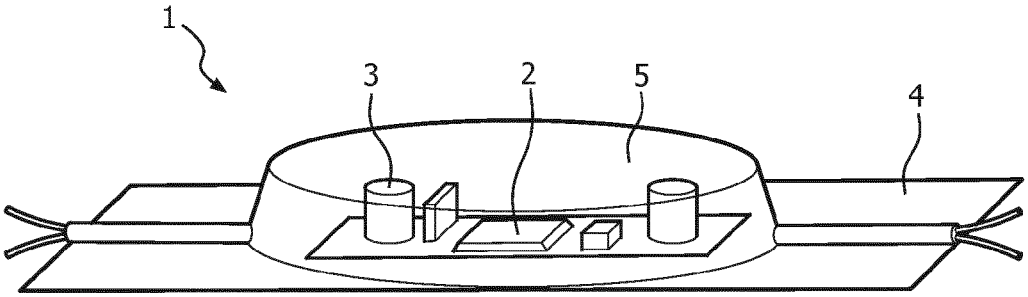
FIG. 1 shows an embodiment of a lighting device.

FIG. 1 shows an embodiment of a lighting device 1. The lighting device comprises a light source 2, a driver 3, for providing an output to said light source, and a first housing 4. The first housing 4 is a blister pack that comprises at least one compartment 5.

A blister pack is a term for several types of preformed plastic packaging. The primary component of a blister pack is a cavity or pocket made from a formable web, usually a thermoformed plastic. This may have a backing of paperboard or a lidding seal of aluminum foil or plastic.

Blister packs are useful for protecting products against external factors, such as humidity, moisture and contamination for extended periods of time. A common method of production is to use heat and pressure via a die to form the cavity or pocket from a roll or sheet of plastic.

A hinged blister is known as a clamshell, these comprise one sheet folded over on itself and sometimes fused at the edges. They can be securely heat sealed.

In the case of thermoforming, a plastic film or sheet is unwound from a reel and guided through a pre-heating line on the blister production line. The temperature of the pre heating plates (usually an upper and lower plate) is such that the plastic will soften and become pliable. The warm plastic will then arrive at a forming station where a large pressure, usually 4-8 bar, will form the blister cavity into a negative mold. The mold is cooled such that plastic cools and becomes rigid enough to maintain its shape when removed from the mold. In cases of difficult blister shapes or larger sizes, the warm film may be physically pushed down partially into the cavity by a plug assist feature. The plug is used to partially depress the warmed film into the mold cavity before the pressure is applied to draw the material to the cavity walls (negative pressure forming) or blow the material to the cavity wall (positive pressure forming). This plug assist increases the uniformity of the wall thickness of the blister pack.

Inserting the light source 2 and driver 3 inside the first housing 4 allows a lighting device 1 to be constructed that is protected from external factors and is suitable for inclusion in a variety of further products. The first housing 4 may have more than one compartment. A heat sink such as a fluid enclosed in a bag may be inserted into a second compartment within the first housing 4. The fluid would be in thermal contact but not electrical contact with the light source 2. This would allow a lighting device 1 to be manufactured that is electrically safe and thermally managed. Obviously if the light source 2 does not produce enough of a thermal load to require a heat sink than this is not necessary.

Figure 2:
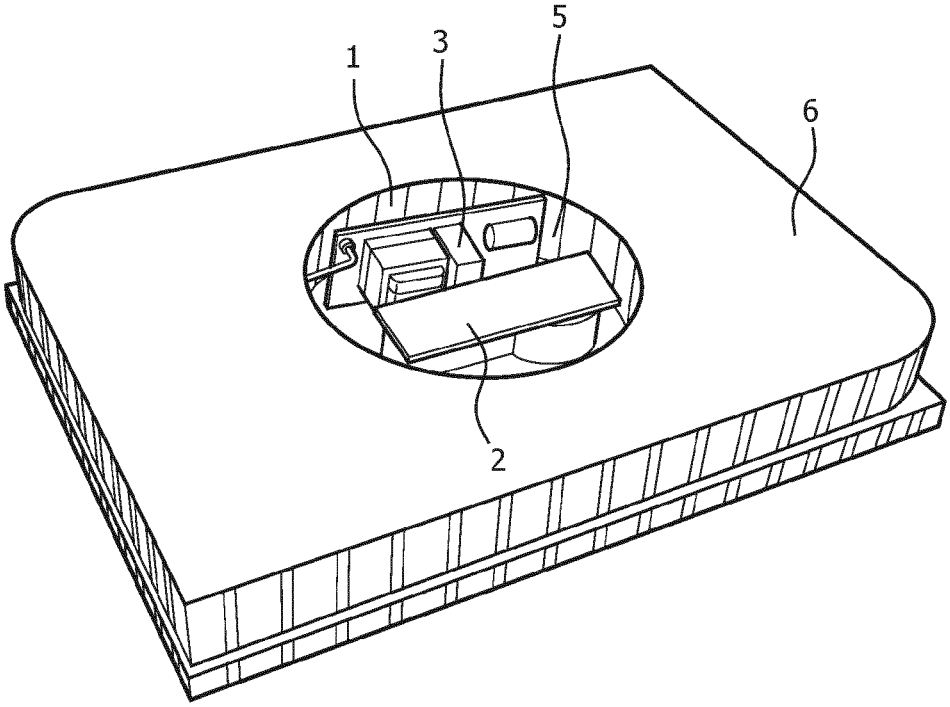
FIG. 2 shows an embodiment of a lighting device with a second housing.

FIG. 2 shows an embodiment of a lighting device 1 with a second housing 6. The second housing 6 comprises a laminate. This laminate may be a honeycomb structure laminate, it may be a corrugated structure laminate or it may be another form of laminate. The second housing 6 may be a paper laminate such as a cardboard, also known as fiberboard or it may be a plastic laminate.

Corrugated fiberboard is a paper-based material consisting of a fluted corrugated sheet and one or two flat linerboards. It is manufactured using flute lamination machines or corrugators. The corrugated medium and linerboard are usually made with a wall thickness of over 0.25 mm thick. As a further advantage, paper laminates are widely recycled and this may reduce environmental waste.

Corrugated plastic is a wide range of extruded twinwall plastic-sheet products usually produced from high impact polypropylene resin with a similar structure to corrugated cardboard. It is a light-weight and tough material that can be easily cut with a craft knife.

Chemically, the sheet is inert, with a neutral pH factor. At regular temperatures most oils, solvents and water have no effect, allowing it to perform under adverse weather conditions or as a product component exposed to harsh chemicals.

Honeycomb structures are natural or man-made structures that have the geometry of a honeycomb to allow the minimization of the amount of used material to reach minimal weight and minimal material cost. The geometry of honeycomb structures can vary widely but the common feature of all such structures is an array of hollow cells formed between thin vertical walls. The cells are often columnar and hexagonal in shape. A honeycomb shaped structure provides a material with minimal density and relative high out-of-plane compression properties and out-of-plane shear properties. Man-made honeycomb structural materials are commonly made by layering a honeycomb material between two thin layers that provide strength in tension. This forms a plate-like assembly. The second housing 6 may even be embedded into a wall of a building or further may be a sheet like building material containing at least one light source 2, driver 3 and first housing 4.

Figure 3:
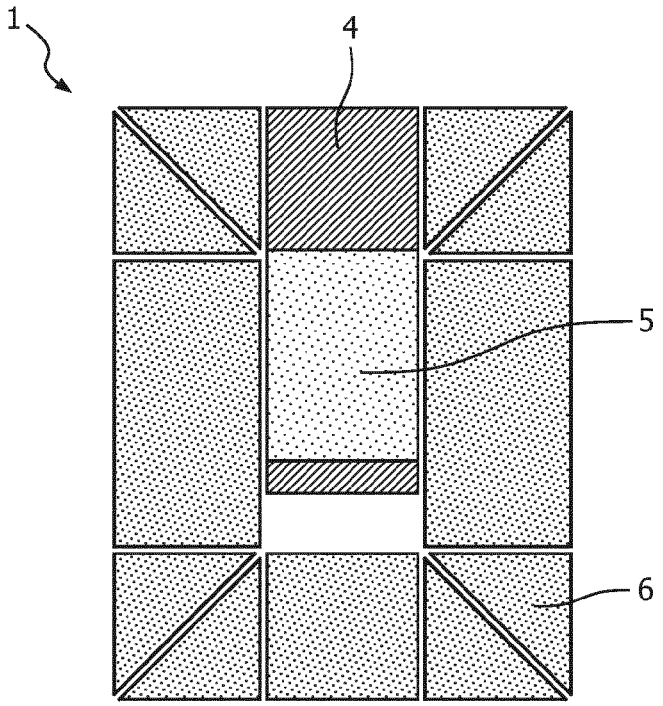
FIG. 3 shows an embodiment of a lighting device with a folded second housing.

FIG. 3 shows an embodiment of a lighting device 1 with a second housing 6 that is folded. The folding is advantageous as it allows a light source 2 and driver 3 to be inserted into a laminate without compromising the laminate's strength.

Conventionally, these components are inserted into the hollow housing of the plastic or Al batten. And such hollow housings can be easily capped by blind-caps or daisy-chaining bulk-head caps, routing the through wire connection from one end to the other end of the batten. Thus the key feature that gives the laminated cardboard their strength, the honeycomb, represents a volumetric issue when it comes to providing space to accommodate for example an LED driver 3, through wiring and other components.

A solution to creating volume in laminate structures, while preserving the surface appearance from all viewing directions, is to machine or to mill the laminate such that for example a "hollow" cube can be folded. This can be completed by machining a V-groove. Unfortunately, when the board laminate is thin, the strength and rigidness of the ribs is not always sufficient. This holds in particular when the top and bottom planes are removed and even more when building a 4 ft. square-shaped pipe i.e. a paper based batten. In addition, when the pipe is loaded externally, the structure can be deformed easily and worse, under high loads, the thin ribs comprising only of the thin laminate, can crack, fracture or tear apart. Thus the structural integrity of the housing is lost. When the surface laminate layer is (too) thick, it can't be folded/bent.

Sustaining rigidity can be resolved in several ways; by adding additional mechanical supports in the form of inner ribs. By stacking multiple thin laminates having cut sections in between the outer two laminates. By cutting or creating a cavity or half cavity (two symmetric halves) by perpendicular cutting from one surface layer to the other, clad on both sides by thin laminates. Yet another option is to fold a batten by combining both cut cavities, laminated stacks and milled boards. This allows for simple vertical insert assembly, followed by folding or rolling and fixing the folded assembly by pressing in housing enclosing end-caps.

Figure 4:
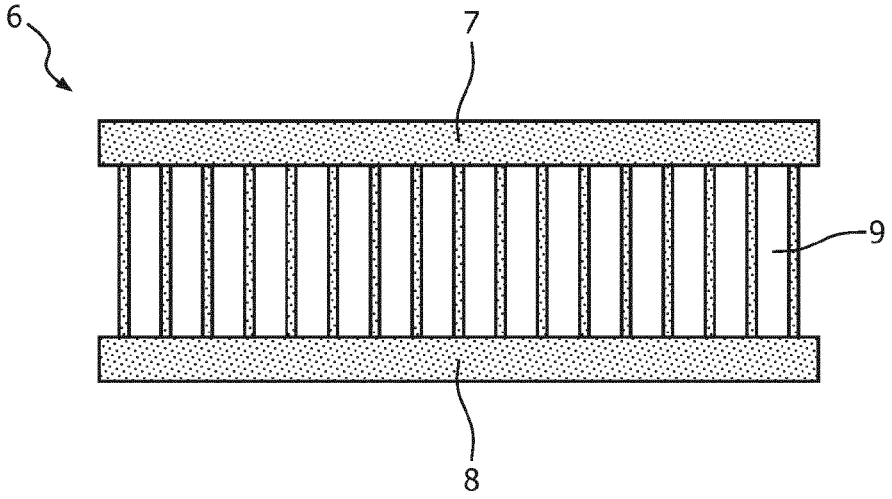
FIG. 4 shows an embodiment of a second housing.

FIG. 4 shows an embodiment of a second housing 6. The second housing 6 comprises a first surface 7, a second surface 8 and a honeycomb structure 9. The first surface 7 and second surface 8 may comprise a different material to each other and/or to the honeycomb structure. This is called a hybrid laminate and allows the tailoring of desired properties for the housing. For example, an Aluminum foil may be included in the laminate to provide heat sinking and/or electrical connectivity. A decorative laminate may be constructed having a first surface 7 that is aesthetically pleasing with a paper honeycomb structure 9 and a paper second surface 8.

Figure 5:
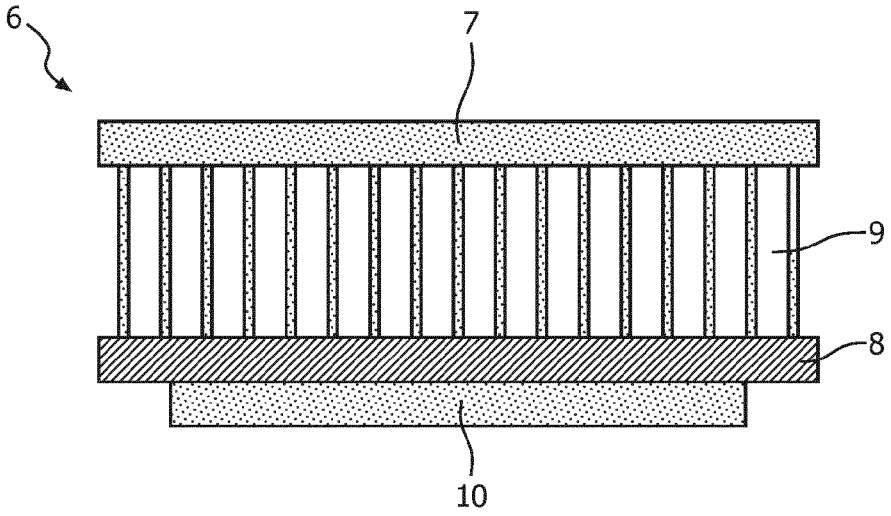
FIG. 5 shows an embodiment of a second housing and a heat sink.

FIG. 5 shows an embodiment of a second housing 6 and a heat sink 10, the heat sink 10 may be a fluid or gel-filled bag that is thermally attached to the light source (not shown). Advantageously this heat sink 10 is included in a further compartment within the first housing.

Figure 6:
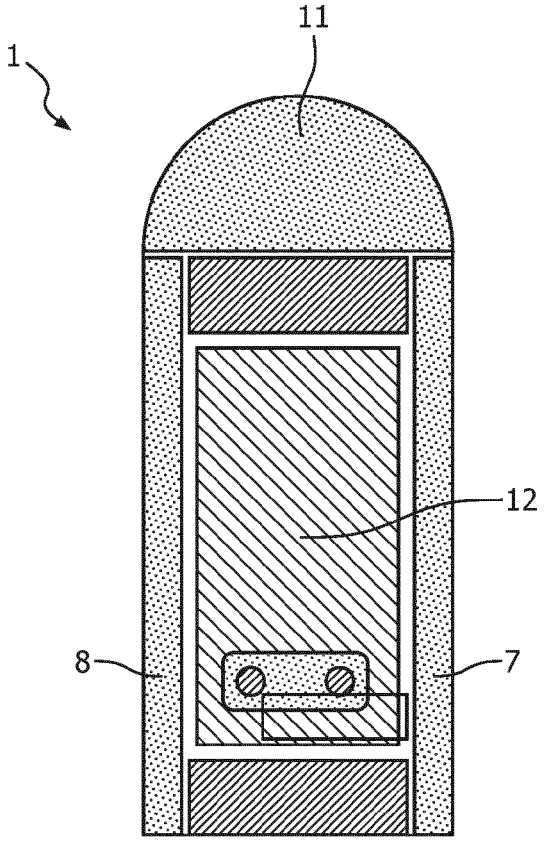
FIG. 6 shows an embodiment of a lighting device having an optical exit window and an end cap.

FIG. 6 shows an embodiment of a lighting device 1 having an optical exit window 11 and an end cap 12. The light source 2, driver 3 and first housing 4 can be fitted into a cut out within the second housing 6 or it may be that the second housing 6 is folded and the electronics are situated in the cavity created. An optical exit window 11 may be fitted to manipulate the light emitted and end caps 12 may be fitted to provide an electrical connection and/or to mechanically strengthen the lighting device 1.

Figure 7A:
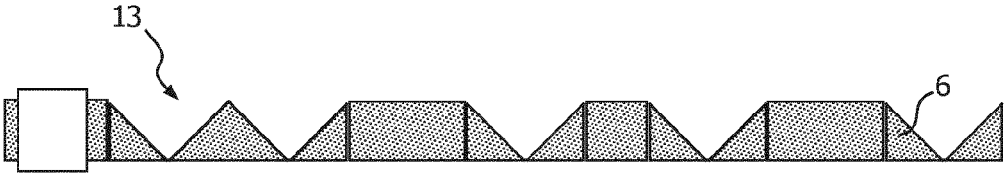
FIGS. 7A-7E shows an embodiment of a second housing being folded and fitted with an end cap.

FIG. 7A shows a second housing 6 laid out flat with grooves 13; these grooves are included to facilitate the easy folding of the second housing 6.

Figure 7B:
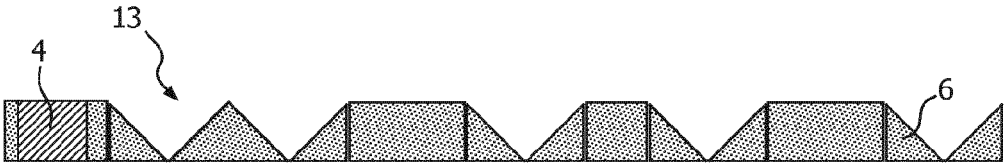

FIG. 7B shows the first housing (including the light source and driver) inserted into the second housing 6.

Figure 7C:
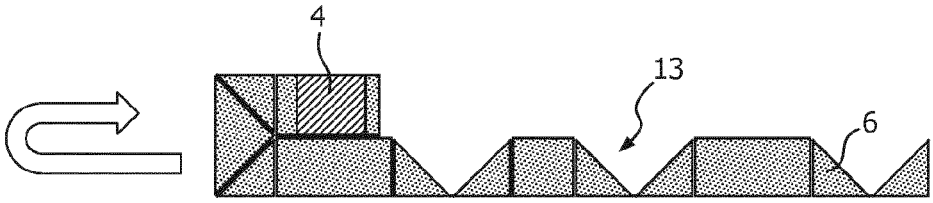

FIG. 7C shows a second housing 6 in the initial stage s of folding. It can be seen that the grooves 13 facilitate the folding whilst maintaining the surface finish of the second housing 6.

Figure 7D:
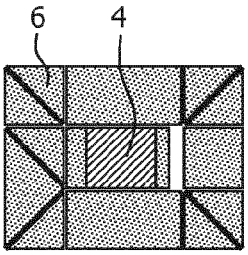

FIG. 7D shows a second housing 6 folded into a square pipe shape with the first housing 4 at the center. This provides protection for the light source 2 and driver 3 and will allow the light emitted to escape via a light exit window (not shown).

Figure 7E:
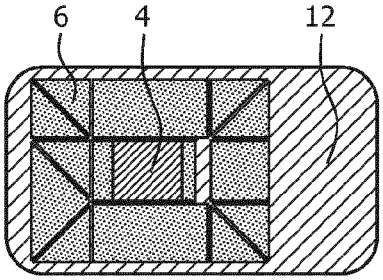

FIG. 7E shows end caps 12 fitted to the ends of the second housing 6. This will provide an electrical connection and/or to mechanically strengthen the lighting device.

The invention claimed is:

1. A lighting device comprising:

a light source, a driver for providing an output to said light source, a first housing, and a second housing configured to accept the first housing, wherein said first housing comprises a blister pack with at least one compartment suitable for locating said light source and driver, wherein said second housing comprises a laminate with a first surface opposite a second surface, said first surface and second surface sandwiching a corrugated center structure and the first housing is located between said first surface and said second surface.

2. A lighting device according to claim 1 further comprising:

an optical member for manipulating the light output by said light source, and a thermal member, wherein said thermal member comprises a flexible heat sink and/or a heat-spreader and said thermal member is located within said first housing.

3. A lighting device according to claim 1 wherein said second housing comprises a plastic laminate.

4. A lighting device according to claim 1 wherein said second housing comprises a paper laminate.

5. A lighting device according to claim 1 wherein said second housing comprises a hybrid corrugated laminate wherein said corrugated structure comprises a paper structure and at least one of said first surface or said second surface comprise a further material.

6. A lighting device according to claim 1 wherein said second housing forms a luminaire.

7. A lighting device according to claim 1 wherein at least one of said first or said second surfaces comprises a decorative veneer.

8. A lighting device according to claim 1 wherein said second housing further comprises a light exit window for transmitting the light emitted by said light source.

9. A lighting device according to claim 1 wherein said second housing comprises a foldable corrugated laminate.

10. A lighting device according to claim 9 wherein said second foldable housing is configured to be folded in a first direction for transportation and subsequently folded in a second direction before operation.

11. A lighting device according to claim 3 wherein said second housing comprises a hybrid corrugated laminate wherein said corrugated structure comprises a plastic structure and at least one of said first surface or said second surface comprise a further material.

* * * * *